US006823552B1

(12) United States Patent
Hillenbrand

(10) Patent No.: US 6,823,552 B1
(45) Date of Patent: Nov. 30, 2004

(54) COMBINATION CLOTHES DRIER AND DUCT CLEANING BRUSH

(76) Inventor: Stephen J Hillenbrand, P.O. Box 1491, San Ramon, CA (US) 94583

( * ) Notice: Subject to any disclaimer, the term of this patent is extended or adjusted under 35 U.S.C. 154(b) by 0 days.

(21) Appl. No.: 10/713,826

(22) Filed: Nov. 17, 2003

(51) Int. Cl.[7] ..... A46B 3/18; B08B 9/02
(52) U.S. Cl. ..... 15/104.2; 15/106; 15/206
(58) Field of Search ..... 15/104.16, 104.2, 15/106, 206

(56) References Cited

U.S. PATENT DOCUMENTS

| | | | | |
|---|---|---|---|---|
| 1,962,854 A | * | 6/1934 | Anderson | 15/206 |
| 1,967,597 A | * | 7/1934 | Rudolf | 15/206 |
| 4,819,291 A | * | 4/1989 | Gunjian | 15/104.2 |
| 5,253,386 A | * | 10/1993 | LaLonde | 15/206 |
| 5,297,310 A | * | 3/1994 | Cox et al. | 15/106 |

FOREIGN PATENT DOCUMENTS

| | | | |
|---|---|---|---|
| EP | 456402 | * | 11/1991 |
| GB | 818278 | * | 8/1959 |
| JP | 2002-209848 | * | 7/2002 |

* cited by examiner

*Primary Examiner*—Mark Spisich

(57) ABSTRACT

Combination clothes dryer and duct cleaning brush with a length of twisted strand metal wire approximately fifty inches long, a plurality of first bristles radially emanating from one end of each end of the wire length, a plurality of second bristles radially emanating from the opposite end of the wire length, a first and second protective cap fixedly attached to each end tip of the wire length, and a flexible plastic tube that encloses the central portion of the wire length and extends from the inside edge of the first set of bristles to the inside of the second set of bristles. The first set of bristles are eleven and one half inches long and conical in shape and the second set of bristles are cylindrical in shape and are four inches in diameter and two inches long.

6 Claims, 2 Drawing Sheets

COMBINATION CLOTHES DRIER AND DUCT CLEANING BRUSH

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of cleaning brushes and more specifically to a combination clothes drier and duct cleaning brush. Cleaning brushes of many kinds are well known. One type if brush construction involves twisting a pair of metal wires and, while the wire is being twisted, inserting a plurality of bristles radically at a ninety degree angle. The final construction allows for a somewhat flexible brush where the brush head can be inserted into non linear orifices. Although brushes of this type exist, there does not exist a single brush tool that can clean both the duct portion of a standard clothes drier as well as the lint storage portion of a standard clothes drier.

Additionally, there does not exist a cleaning brush that incorporates bristles of polyester on one end of the cleaning brush and bristles of nylon on the opposite end of the cleaning brush.

BRIEF SUMMARY OF THE INVENTION

The primary object of the invention is to provide a combination clothes drier and duct cleaning brush.

Another object of the invention is to provide a combination brush where one end is designed to clean the lint trap of a standard clothes drier and the opposite side is designed to clean a standard clothes drier duct or air register or the like.

Another object of the invention is to provide a combination brush where the bristles do not loose stiffness when wet.

A further object of the invention is to provide a combination brush where the tips of the brush are protected to that internal surfaces of a clothes drier or duct are not damaged.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a combination clothes dryer and duct cleaning brush comprising: a length of twisted strand of metal wire approximately fifty inches long, a plurality of first bristles radially emanating from one end of each end of said wire length, a plurality of second bristles radially emanating from the opposite end of said wire length, a first and second protective cap fixedly attached to each end tip of said wire length, and a flexible plastic tube that encloses the central portion of said wire length and extends from the inside edge of said first set of bristles to the inside of said second set of bristles.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
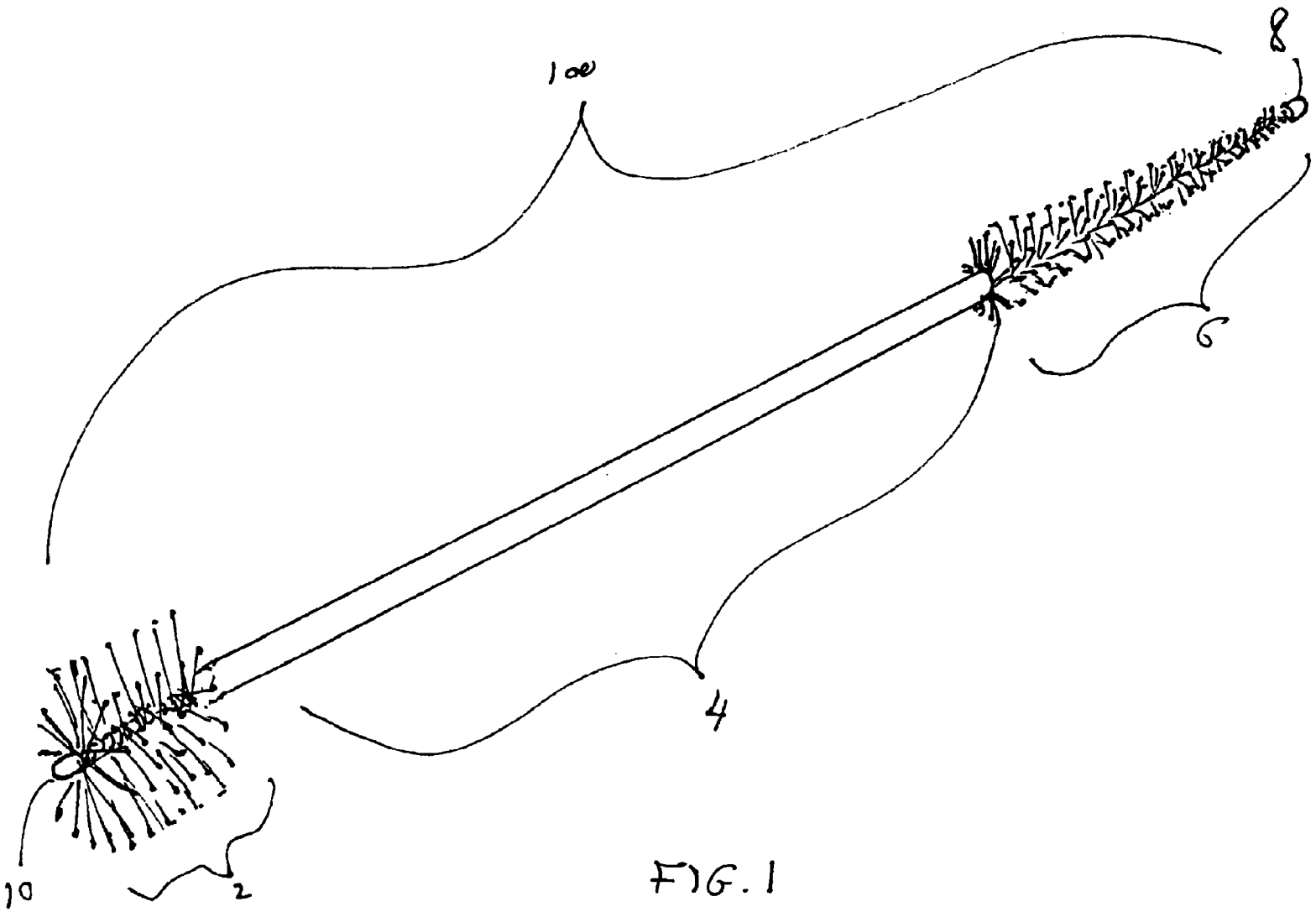
FIG. 1 is a perspective view of the invention.

Referring now to FIG. 1 we see a perspective view of the invention 100. The cleaning brush of this invention has a cleaning head on each end. The first cleaning head 6 is conical in shape and is constructed of low burgomaster polyester S strand material and are rather densely packed when intertwined with a pair of metal wires during a standard brush construction procedure. The conical brush shape 6 is approximately eleven and one half inches long, one and one quarter of an inch at the widest diameter and three quarters of an inch in diameter at the smallest diameter. The S strand polyester bristles are an ideal choice for cleaning lint from a standard clothes dryier in that they will not damage the interior surfaces of the drier and maintain stiffness even when wet. The taper of the brush 6 allows the brush head 6 to more easily enter and traverse the interior of standard lint traps found in standard clothes driers. The relatively soft bristles made as described above tend to draw in and removably retain lint and hairs that standard lint traps miss so that the lint can be safely removed from internal areas of a standard clothes drier. The opposite side of the cleaning brush 100 includes a second brush head 2 that is designed for cleaning standard flexible ducts that are used to provide an exit for moist air that is a result of drying activity in a standard clothes drier. These ducts tend to be four inches in diameter. Therefore the duct cleaning head 2 is comprised of a plurality of bristles that form a brush head approximately four inches in diameter and approximately two inches long. The length of the entire invention 100 is approximately fifty inches. This length was chosen so that the user can effectively clean far into standard drier ducts.

Figure 2:
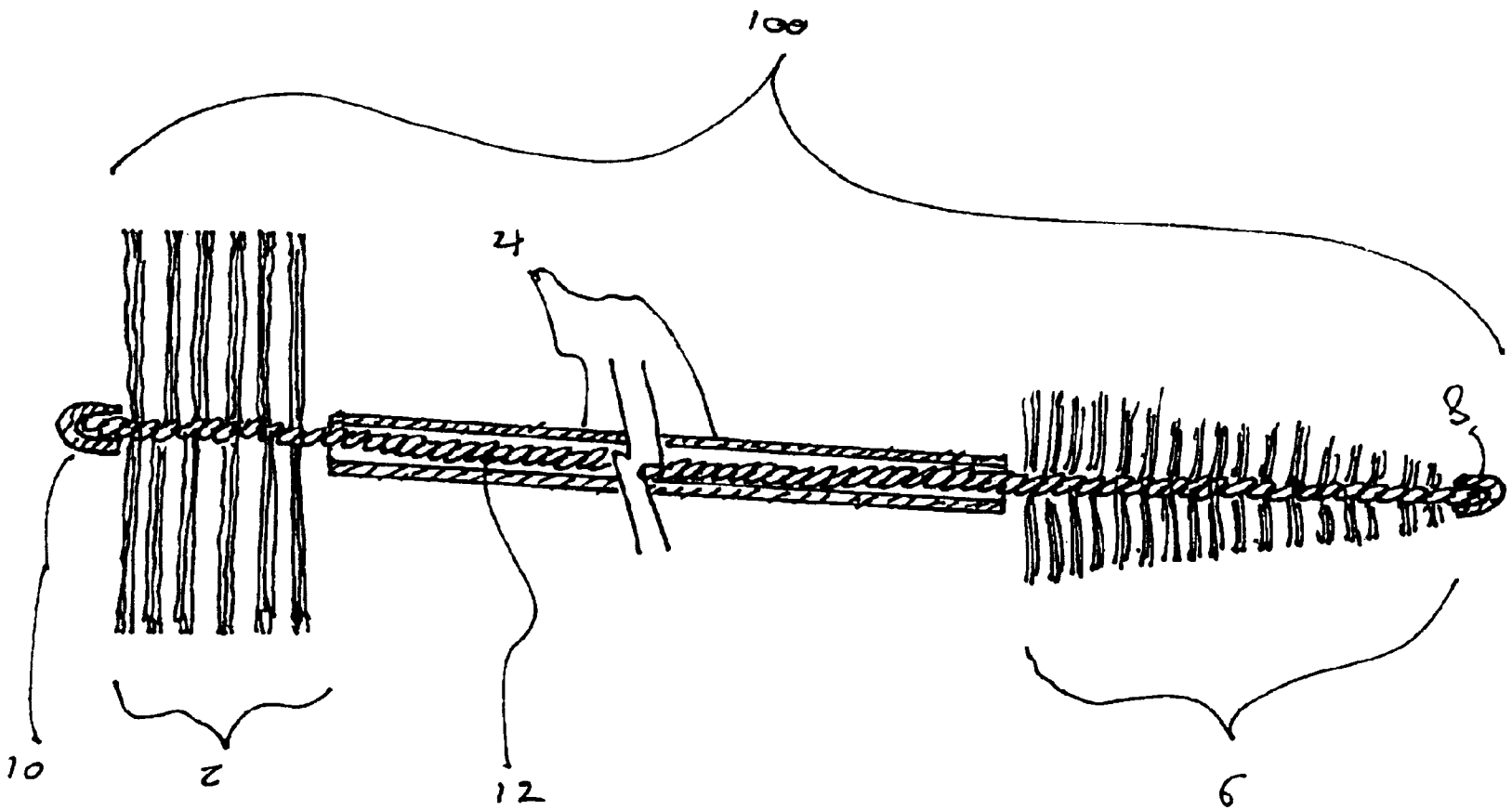
FIG. 2 is a side section view of the invention.

FIG. 2 shows a side section view of the present invention 100. This view shows the twisted wire pair 12 that is comprised of two strands of metal wire, each approximately one tenth of an inch in diameter. The combination of this wire diameter and the surrounding plastic tube 4 leads to the ideal flexibility to traverse non linear duct interiors, yet be stiff enough not to fold or kink during use. Each end of wire pair 12 is capped with a plastic enclosure 8, 10. The caps are made of a soft burgomaster plastic such as EVA and prevent the tips of the brush from damaging the interior of clothes driers or other items being cleaned by the brush 100. The duct cleaning head 2 is also ideal for cleaning the interior of heating registers and the like.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Combination clothes dryer and duct cleaning brush comprising:

a length of twisted strand metal wire approximately fifty inches long;

a set of a plurality of first bristles radially emanating from one end of said wire length;

a set of a plurality of second bristles radially emanating from the opposite end of said wire length;

a first and second protective cap fixedly attached to a respective end tip of said wire length; and a flexible plastic tube that encloses the central portion of said wire length and extends from the inside edge of said first set of bristles to the inside of said second set of bristles.

2. Combination clothes dryer and duct cleaning brush as claimed in claim 1 wherein said first set of bristles form a conical shape where they are approximately one and one quarter inches in diameter at the inner end and approximately three quarters of an inch in diameter at the outer end and approximately eleven and one half inches long.

3. Combination clothes dryer and duct cleaning brush as claimed in claim 1 wherein said first set of bristles is constructed of S strand polyester filaments that do not loose stiffness when wet.

4. Combination clothes dryer and duct cleaning brush as claimed in claim 1 wherein said second bristle set form a cylindrical shape having a diameter of approximately four inches and a length of approximately two inches.

5. Combination clothes dryer and duct cleaning brush as claimed in claim 1 wherein said second bristle set are constructed of nylon bristles each having a diameter of approximately thirty three thousandths of an inch.

6. Combination clothes dryer and duct cleaning brush as claimed in claim 1 wherein said plastic tube is constructed of nylon tubing having a wall thickness of approximately forty thousandths of an inch.

* * * * *